US010221570B2

(12) United States Patent
Schmidt

(10) Patent No.: US 10,221,570 B2
(45) Date of Patent: Mar. 5, 2019

(54) ANCHORAGE DEVICE

(71) Applicant: Danmarks Tekniske Universitet, Kgs. Lyngby (DK)

(72) Inventor: Jacob Wittrup Schmidt, Copenhagen Ø (DK)

(73) Assignee: Danmarks Tekniske Universitet, Kgs. Lyngby (DK)

( * ) Notice: Subject to any disclaimer, the term of this patent is extended or adjusted under 35 U.S.C. 154(b) by 0 days.

(21) Appl. No.: 15/738,221

(22) PCT Filed: Jun. 24, 2016

(86) PCT No.: PCT/EP2016/064705
§ 371 (c)(1),
(2) Date: Dec. 20, 2017

(87) PCT Pub. No.: WO2016/207371
PCT Pub. Date: Dec. 29, 2016

(65) Prior Publication Data

US 2018/0179756 A1 Jun. 28, 2018

(30) Foreign Application Priority Data

Jun. 26, 2015 (EP) ..... 15174062

(51) Int. Cl.
*E04C 5/12* (2006.01)

(52) U.S. Cl.
CPC ..... *E04C 5/122* (2013.01); *E04C 5/127* (2013.01)

(58) Field of Classification Search
CPC ..... E04C 5/122; E04C 5/127
See application file for complete search history.

(56) References Cited

U.S. PATENT DOCUMENTS 4,707,890 A * 11/1987 Savall ..... E04C 5/122 24/122.6
7,765,752 B2 * 8/2010 Hayes ..... E04C 5/122 403/374.1

(Continued)

FOREIGN PATENT DOCUMENTS

BE 552527 A 12/1959
FR 2686915 A1 8/1993

(Continued)

OTHER PUBLICATIONS

European Patent Office, International Search Report and Written Opinion in corresponding International Patent Application No. PCT/EP2016/064705, dated Aug. 24, 2016 (10 pages).

*Primary Examiner* — Rodney Mintz
(74) *Attorney, Agent, or Firm* — Nixon Peabody LLP

(57) ABSTRACT

An anchoring device for anchoring tendons for structural reinforcement. The anchoring device has a longitudinal central axis defining an axial direction. The anchoring device includes an outer barrel and an inner wedge. The outer barrel has a cylindrically or frusto-conically shaped inner surface defining a cylindrically or frusto-conically shaped inner space. The inner wedge has a frusto-shaped outer surface and a coaxial bore. The shaped inner space is configured for allowing the inner wedge to be positioned in the shaped inner space of the outer barrel in the axial direction. The coaxial bore of the inner wedge is configured for receiving a tendon. The inner wedge includes inner and outer portions, the inner portion overlapping the outer portion as seen in a radial direction. The inner and outer portions are separated by a cut configured for increasing the overlap of the inner and outer portions upon exertion of (Continued)

radially compressive forces on the wedge, thereby reducing the circumference of the coaxial bore upon interaction with the outer barrel.

18 Claims, 5 Drawing Sheets

(56) References Cited

U.S. PATENT DOCUMENTS 8,046,964 B2 * 11/2011 Zimmer ..... F16B 13/002 411/32
8,171,697 B2 * 5/2012 Zimmer ..... F16B 13/144 411/32
8,250,828 B2 * 8/2012 Zimmer ..... F16B 5/01 411/82.3
8,387,340 B2 * 3/2013 Zimmer ..... F16B 13/144 411/32
8,464,494 B2 * 6/2013 Zimmer ..... F16B 5/01 411/32
2009/0205273 A1 * 8/2009 Hayes ..... E04C 5/122 52/223.13
2009/0274533 A1 * 11/2009 Zimmer ..... F16B 13/002 411/49
2009/0274534 A1 * 11/2009 Zimmer ..... F16B 13/063 411/57.1
2010/0115882 A1 * 5/2010 Seroiszka ..... F16B 5/01 52/787.1
2010/0175345 A1 * 7/2010 Zimmer ..... F16B 13/144 52/711
2010/0178130 A1 * 7/2010 Zimmer ..... F16B 13/02 411/80.2
2010/0180535 A1 * 7/2010 Zimmer ..... F16B 13/063 52/699
2010/0186340 A1 * 7/2010 Nakamura ..... E04C 5/122 52/684
2010/0281817 A1 * 11/2010 Zimmer ..... F16B 5/01 52/705
2010/0287874 A1 * 11/2010 Zimmer ..... F16B 13/0858 52/699
2010/0287875 A1 * 11/2010 Zimmer ..... F16B 13/0858 52/699
2011/0027037 A1 * 2/2011 Zimmer ..... F16B 5/01 411/82
2011/0083397 A1 * 4/2011 Zimmer ..... F16B 13/0858 52/699
2011/0232223 A1 * 9/2011 Zimmer ..... F16B 13/0833 52/699
2011/0232224 A1 * 9/2011 Zimmer ..... F16B 5/01 52/699

FOREIGN PATENT DOCUMENTS

GB 1387818 A 3/1975
WO WO 86/02705 A1 5/1986

* cited by examiner

DETAIL A

ANCHORAGE DEVICE

CROSS-REFERENCE TO RELATED APPLICATIONS

This application is a U.S. National Stage of International Application No. PCT/EP2016/064705, filed Jun. 24, 2016, which claims the benefit of European Patent Application No. 15174062.8, filed Jun. 26, 2015, both of which are incorporated herein by reference in their entireties.

The present invention relates to an anchorage device for anchoring tendons for structurally reinforcing a structure such as a concrete structure, where the anchoring device has a longitudinal central axis defining an axial direction, and in the axial direction a distal end and a proximal end; said anchoring device comprises an outer barrel and an inner wedge; said outer barrel has a cylindrically or frusto-conically shaped inner surface defining a cylindrically or frusto-conically shaped inner space; said inner wedge comprises a frusto-shaped outer surface and a coaxial bore; said frusto-conically shaped inner space is configured for allowing said inner wedge to be positioned at least partly in said frusto-conically shaped inner space of the outer barrel in the axial direction; said coaxial bore of said inner wedge is configured for receiving a tendon

BACKGROUND OF THE INVENTION

It is well known to use anchoring devices comprising a barrel and a wedge as an anchoring device for tendons, such as steel tendons or fiber reinforced polymer (FRP) tendons. The wedge clamps the steel or FRP tendons mechanically using pressure and friction.

WO 2010/047634 A1 discloses an anchoring device comprising a sleeve (1) with an internal conical space and a wedge element (7). The wedge element is provided with grooves (11,12) which has an extent in both axial and radial directions relative to the central axis of the anchoring device.

However, when anchoring FRP tendons due to the strength properties of the FRP tendons fibers in the transverse direction are poor and the mechanical anchorage have to rely on friction using large compressive stresses from the clamping device known anchoring devices may cause problems as high principal stresses acting on the tendons in the loaded end (proximal end) of the anchorage device, where both tensile and compressive forces are represented, often resulting in premature failure.

As the tension stresses on the tendons are high at the proximal end of the anchoring device, it is advantageous to decrease the radial stresses to decrease the principal stresses at the proximal end of the anchoring device.

Furthermore, to increase the capacity of an anchoring system comprising a barrel and a wedge, it is desirable to provide an anchorage device which increases the grip of the tendons without premature failure.

BRIEF DESCRIPTION OF THE INVENTION

It is an object of the present invention to provide an anchorage device which provides an increased grip between the anchorage device and a tendon.

This is achieved by an anchorage device wherein said inner wedge comprises an inner and an outer portion, said inner portion overlaps said outer portion as seen in a radial direction, wherein the inner portion and the outer portion are separated by a cut, the cut is configured for increasing said overlap of the inner portion and the outer portion upon exertion of radially compressive forces on the wedge, thereby reducing the circumference of the coaxial bore upon interaction with the outer barrel.

Hereby is achieved that the anchoring device provides a better grip and thereby the anchoring device becomes more reliable in regards to managing of stresses acting on the tendons, and by decreasing the radial stresses, the principal stresses on the tendons at the proximal end of the anchoring device are decreased, and the risk of premature failure is minimizing.

Additionally, the risk of the FRP tendons penetrating into the longitudinal groove is reduced.

In an embodiment, said inner portion constitutes a tongue, and said outer portion constitutes a tongue abutting surface.

In an embodiment, the cut extends axially along the entire length of the inner wedge from the distal end to the proximal end.

In an embodiment, the cut extends in a tangential direction from a first radial direction to a second radial direction, enclosing an angle; the cut is configured for allowing deformation of the inner wedge and reducing the diameter of the coaxial bore upon interaction with the barrel.

In an embodiment, the inner surface of said inner wedge has a frusto-shaped surface such as a frusto-parabolic shaped surface.

Hereby is achieved that the high compressive forces are moved to the less tensile stressed parts of the tendon at the back of the anchorage system (in the distal direction) and thus further minimizing the risk of fracture of the tendon due to high principal stresses.

In an embodiment, said inner surface of said inner wedge has a frusto-conically shaped surface.

In an embodiment, the inner wedge comprises one or more longitudinal recesses extending in both axial direction along the entire length of said inner wedge and in radial direction from said frusto-shaped outer surface towards the longitudinal center axis directions.

In an embodiment, said cut extends from an inner distal end of said one or more longitudinal recesses to the inner surface of the coaxial bore.

In an embodiment, said inner and outer portions forms a curved overlap.

Yet in an embodiment, said cut constitute a spiral-shaped curved cut.

In another embodiment, the one or more longitudinal recesses extend helically along the entire length of the inner wedge.

In an embodiment, at least part of the anchoring device is manufactured by laser cutting.

In an embodiment, at least part of the anchoring device is manufactured by 3D printing.

BRIEF DESCRIPTION OF THE DRAWINGS

Embodiments of the invention will be described in the following with reference to the drawings wherein.

DETAILED DESCRIPTION OF THE INVENTION WITH REFERENCE TO THE FIGURES

The present invention relates to an anchoring device (10) comprising a barrel (20) and a wedge (30) for anchoring tendons for structural reinforcing a structure such as a concrete structure.

In that context it may be convenient to define that the term "distal end" (1) of the anchoring device in the appended figures is meant to refer to the end opposite the end where the tendon enters the anchoring device, which is referred to by the term "proximal end" (2). When viewing the anchoring device from the distal end towards the proximal end this is referred to as "the proximal direction", likewise the term "the distal direction" refers to the direction from the proximal end towards the distal end.

The term "frusto-shaped" is meant to refer to any shape having a linearly or curved tapered surface, where the surface extending from a wider base having a peripheral surface converging towards a narrower base, for instance the shape of a frustum of a cone (also referred to as a frusto-shape of a cone or frusto-conical shape).

The term "axial direction" is a direction which runs along the length through the center of the anchoring device, along the longitudinal central axis (A). The term "radial direction" is meant as a direction being perpendicular to the longitudinal central axis (A) and extends radially from the longitudinal central axis (A) and outwards.

The term "tangential direction" is a direction perpendicular to the radial direction, in the direction of a tangent.

Figure 1:
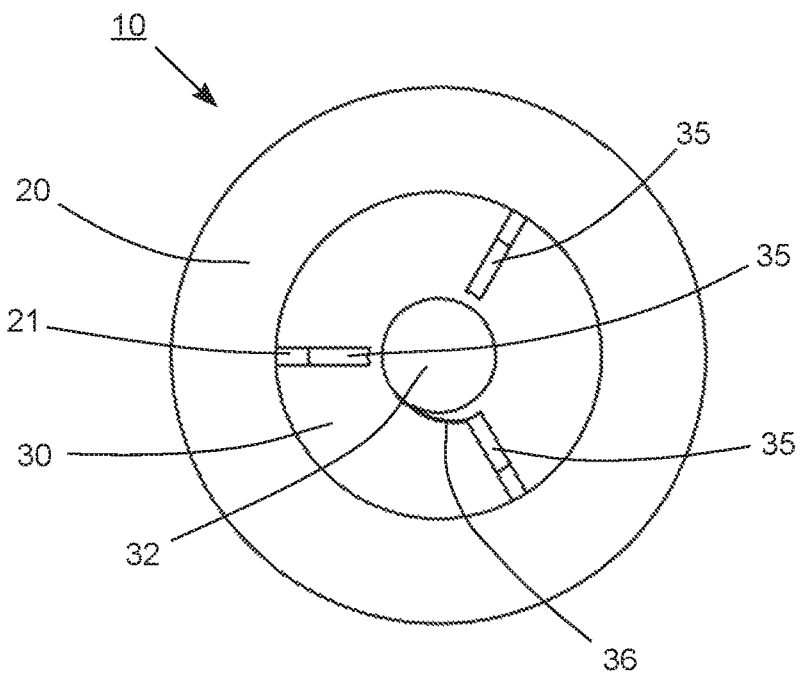
FIG. 1 is an end view of the anchoring device comprising barrel and wedge.
Figure 2:
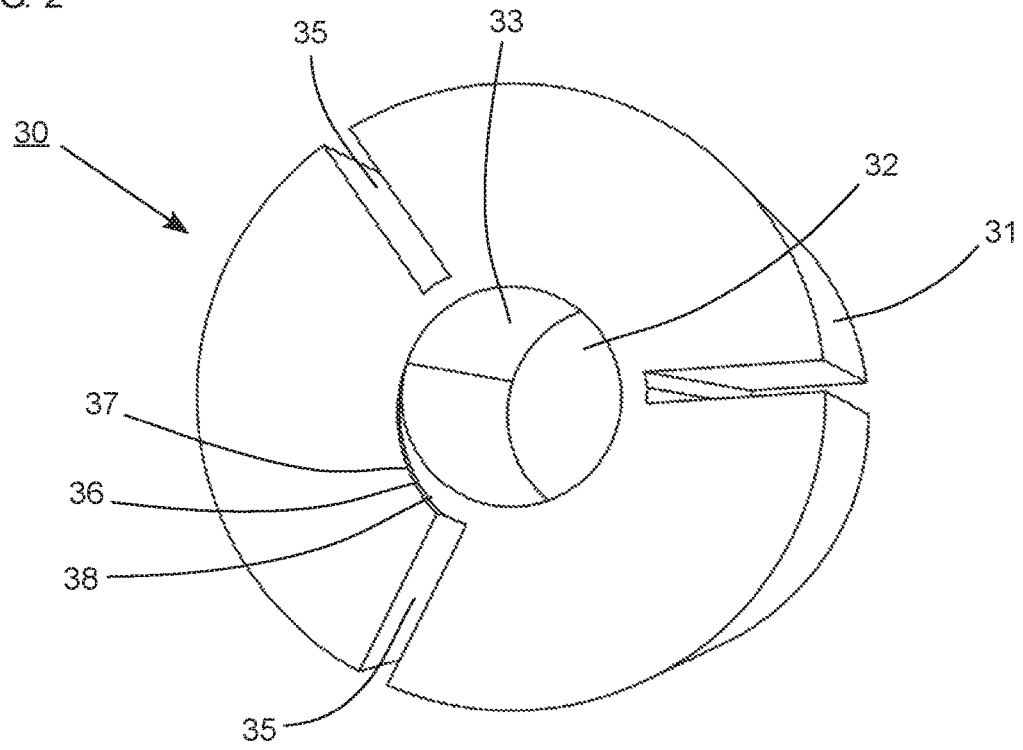
FIG. 2 is a perspective cross-sectional view of the wedge.
Figure 3:
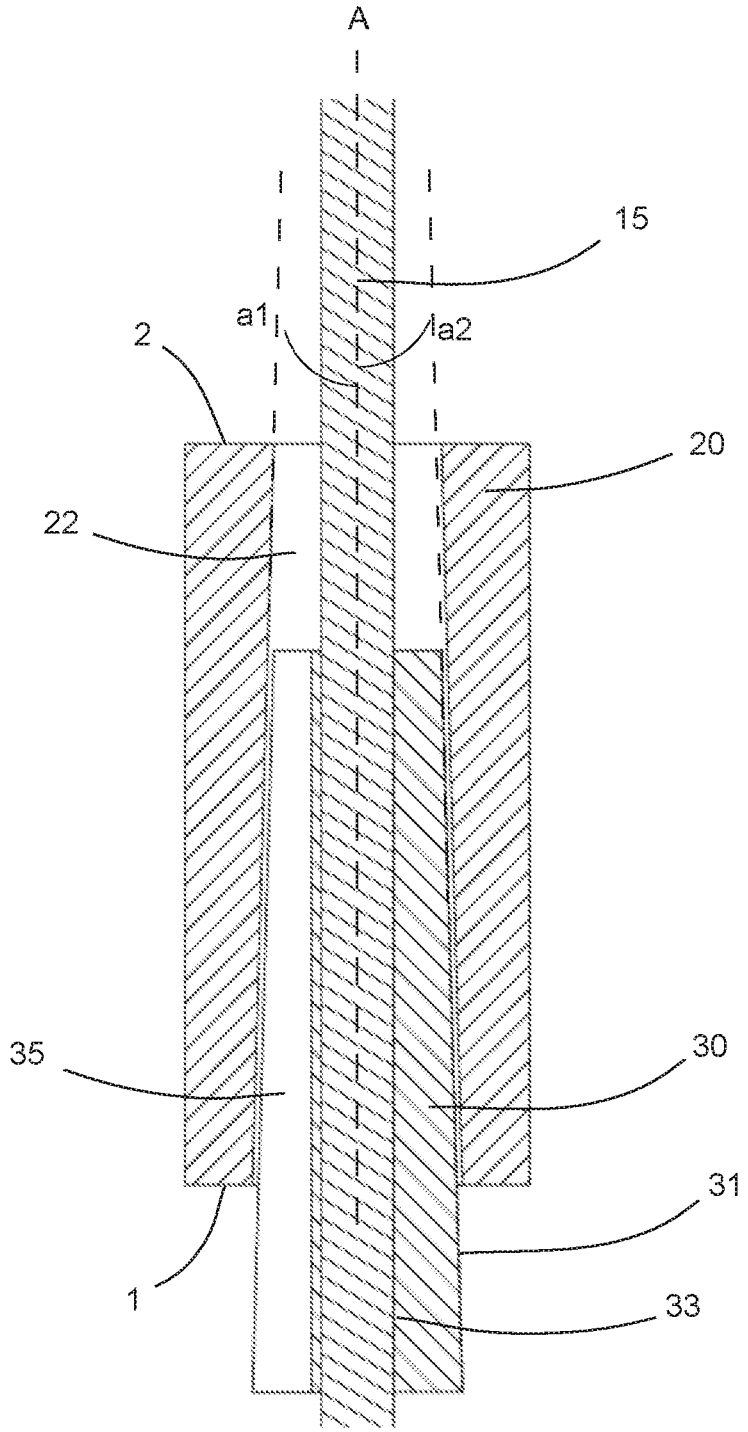
FIG. 3 is a longitudinal cross-sectional view of the anchoring device clamping a tendon.

The anchoring device is illustrated in FIGS. 1, 2 and 3, respectively as an end view showing the outer barrel (20) and the inner wedge (30), a perspective cross-sectional view of the wedge (30) and a longitudinal cross-sectional view of the anchoring device clamping a tendon. The anchoring device (10) has a longitudinal central axis (A) defining an axial direction (A), and in the axial direction a distal end (1) and a proximal end (2).

FIG. 1 illustrates the anchoring device comprising an outer barrel (20) and an inner wedge (30). The barrel (20) has a frusto-conical inner surface (21).

The inner wedge (30) has a circular coaxial bore (32) and three longitudinal recesses (35) equally spaced apart along the periphery of the inner wedge. The longitudinal recesses (35) extend radially from the frusto-conical shaped outer surface (31) of the inner wedge (30) towards the coaxial bore, but not all the way through to the coaxial bore (32).

The three longitudinal recesses (35) extend in both axial and radial directions relative to the central axis (A) of the anchoring device.

As illustrated in FIG. 2 the three longitudinal recesses (35) extend along the whole length of the inner wedge (30). The longitudinal recesses (35) extend radially from the outer surface (31) of the inner wedge (30) towards the coaxial bore (32) defined by the inner surface (33) of the inner wedge. The anchoring device comprises a cut (36), which extends from a distal end of the one or more longitudinal recesses (35) to the coaxial bore (32).

The cut (36) is provided by two overlapping portions, respectively an outer portion (37) and an inner portion (38). The two overlapping portions (37,38) extend tangentially from the inner surface (33) of the coaxial bore (32) and define a cut (36).

FIG. 2 illustrates that the inner portion (38) constitutes a tongue, and the outer portion (37) constitutes a tongue abutting portion, the inner and outer portions (37,38) form a curved overlap. The inner and outer portions (37,38) form a curved overlap, such that the cut (36) constitutes a spiral-shaped curved cut.

The cut (36) extends from the inner surface (33) of the inner wedge (30) in an angel of 0-45 degree from a tangent to the periphery. The cut (36) extends in a tangential direction from a first radial direction to a second radial direction, enclosing an angle, so as to allow deformation of the inner wedge (30) and reducing the diameter of the coaxial bore (32) upon interaction with the barrel.

The cross-section of the inner wedge (30) almost forms a spiral as the longitudinal recess 35 and the cut (36) formed by the overlapping inner and outer portions (37,38) allow the overlapping portions to slide relatively to each other to increase the circumference of the coaxial bore of the wedge and thereby the wedge can increase the clamping effect on a tendon.

FIG. 3 illustrates that the outer barrel (20) has a frusto-conical shaped inner surface (21) defining a frusto-conical shaped inner space (22). The narrow end of said frusto-conical shaped inner space (22) is positioned at the proximal end (2) of the anchoring device. The inner wedge (30) comprises a frusto-conical shaped outer surface (31), where the wide end of the frusto-conical shaped outer surface (31) is arranged in the distal end (1) and the narrow end of the frusto-conical shaped outer surface (31) is arranged at the proximal end (2).

The frusto-conical shaped outer surface (31) of said inner wedge (30) converges the same or more toward the central axis (A) of the anchoring device than the surface of said frusto-conical shaped inner surface (21) of the barrel converge towards the central axis (A), whereby the adjacent surfaces of the barrel and the wedge are approximately parallel or a small peripheral space is provided at the proximal end (2) between the frusto-conical shaped inner surface (21) of the barrel and the frusto-conical shaped outer surface (31) of the inner wedge (30), hereby supporting the effect of reducing the compressive forces acting on the tendons at the proximal end (2).

The inner surface (21) of the barrel and the frusto-conical shaped outer surface (31) of the wedge are arranged abutting each other.

The inner space (22) of the barrel is configured for allowing the inner wedge (30) to be positioned at least partly in the inner space (22).

The inner wedge (30) has an inner surface (33) comprising a shape corresponding to the cross-sectional shape of a tendon to be anchored.

The wedge clamps the tendon mechanically using pressure and friction. However, the inner wedge may additionally be attached to the tendon by swaging, use of an adhesive, welding or combination thereof.

The embodiment of the inner wedge (30) shown in FIG. 2 has a coaxial bore (32) having a circular cross-section.

The inner surface (33) may be frusto-shaped having a diameter at the proximal end (2) larger than a diameter at the distal end (1).

FIG. 3 illustrates a first angle (a1) between the surface of the frusto-conical shaped outer surface (31) of said inner wedge (30) and the central axis of the anchoring device, and a second angle (a2) between the frusto-conical shaped inner surface (21) of said outer barrel (20) and the central axis (A) of the anchoring device. When the first angle (a1) is larger than the second angle (a2), a peripheral space (3) between the barrel and the wedge is provided. The peripheral space (3) provides most space at the proximal end (2) of the anchoring device, hereby supporting the effect of reducing the compressive forces acting on the tendons at the proximal end (2).

The coaxial bore (32) of said inner wedge (30) has a frusto-conical shaped inner surface (33). The inner wedge (30) may comprise a curved frusto-shaped surface, such as a frusto-parabolic shaped surface, see FIG. 5.

The frusto-conical shaped inner space (22) of the barrel is configured for allowing said inner wedge (30) to be positioned at least partly in said frusto-conically shaped inner space (22) in the axial direction; and upon insertion of the inner wedge (30) into the outer barrel (20) in the axial direction, the barrel exert radially compressive forces on the wedge, thereby providing circumferential deformation and/or sheering movement of the inner wedge, allowing the inner wedge to grip the tendon.

Figure 4:
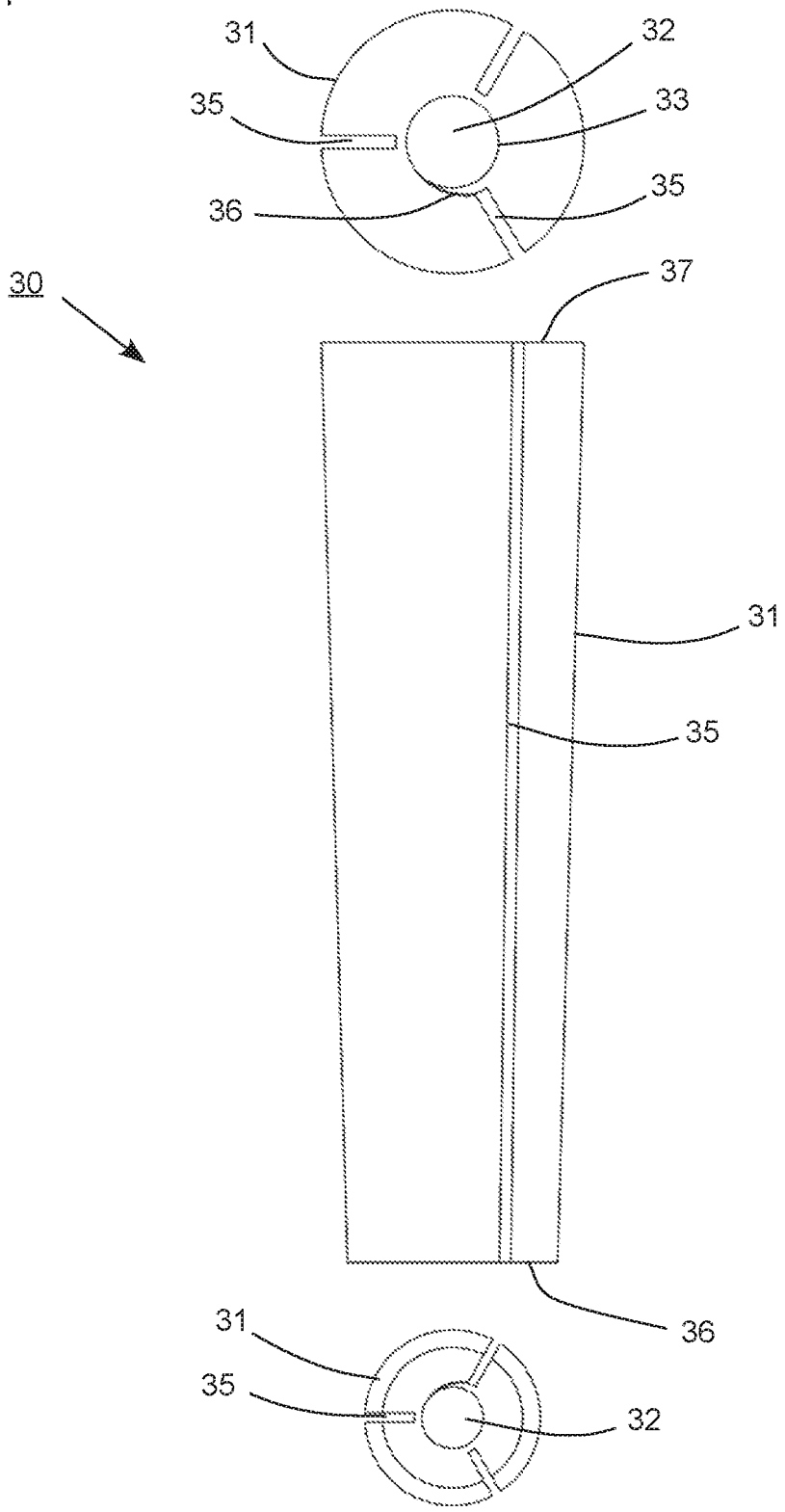
FIG. 4 is a side view and two end views of the wedge.

In FIG. 4 the inner wedge is shown in a side view and two end views.

The inner wedge (30) comprises a frusto-conical shape. The three longitudinal recesses (35) extend along the frusto-conical shaped outer surface (31) of the wedge, throughout the length of the inner wedge (30), from the narrow end to the wide end of the inner wedge (30). The cut (36) extends along the inner surface (33) along the length of the anchoring device from the narrow end to the wide end of the inner wedge (30).

The cut (36) extends from an inner distal end of said one or more longitudinal recesses (35) to the inner surface (33) of the coaxial bore (32).

Figure 5:
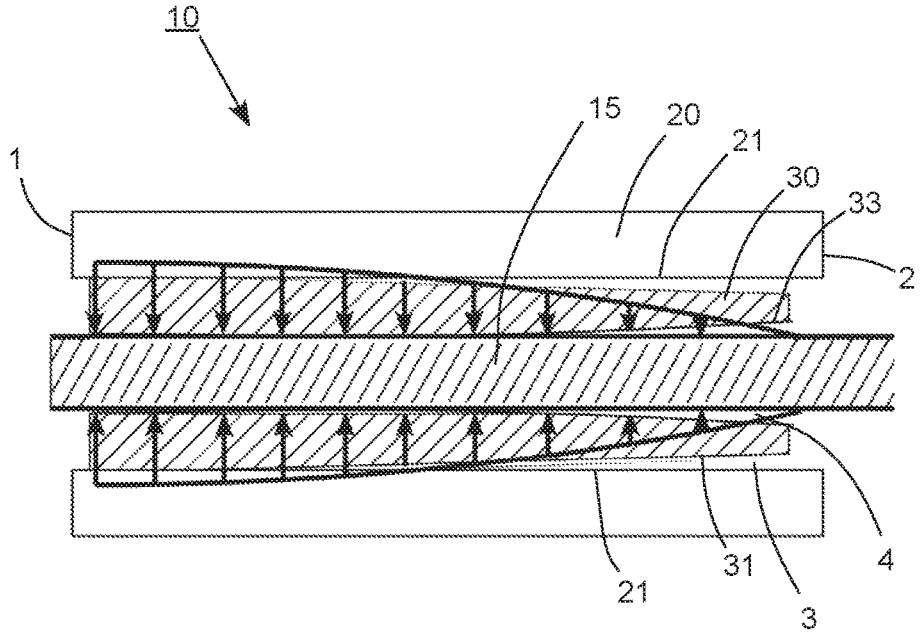
FIG. 5 is a longitudinal cross-sectional view of the anchoring device illustrating transversely forces acting on the tendon, when the wedge of the anchoring device comprises a curved inner surface.
Figure 6:
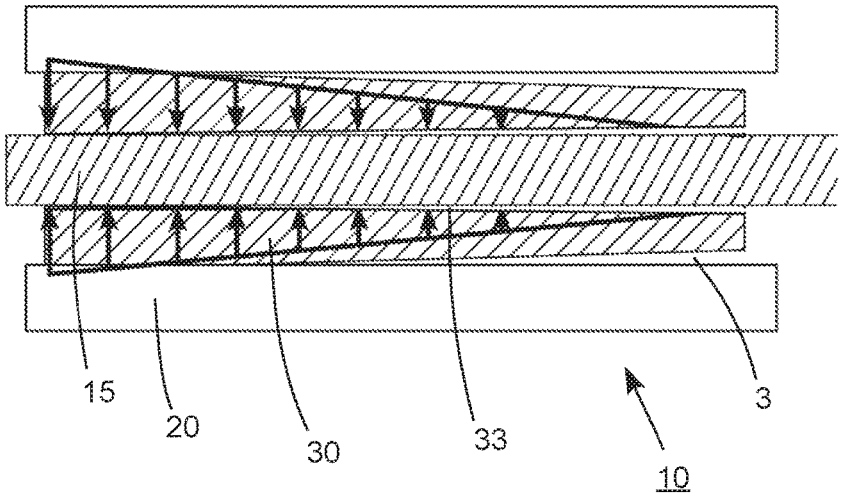
FIG. 6 is a longitudinal cross-sectional view of the anchoring device illustrating transversely forces acting on the tendon, when the wedge of the anchoring device comprises a linear inner surface.

As illustrated in FIGS. 5 and 6, the anchoring device (10) is provided with the peripheral space (3) between the barrel and wedge. Additionally an internal peripheral space (4) between the wedge and the tendon is provided by the inner wedge which has an inner surface (33) which is in the shape of a frustum of a cone. The frusto-shaped inner surface (33) has the narrow end arranged inside the outer barrel (20) at the proximal end (2).

In FIG. 5 the inner wedge (30) has a curved frusto-shaped surface, such as a frusto-parabolically shaped surface or other convergent shape. The frusto-shaped inner surface (33) has a diameter at the proximal end (2) larger than a diameter at the distal end (1).

In FIG. 6 the said coaxial bore (32) of said inner wedge (30) has a linear frusto-conically shaped inner surface (33). The inner surface (33) has a diameter at the proximal end (2) larger than a diameter at the distal end (1).

FIG. 5 illustrates that the linear frusto-conically shaped inner surface (33) provides a transversely pressure which is distributed along the length of the anchoring device in such a way that the forces are increasingly linear towards the distal end (1) of the anchoring device.

Likewise, FIG. 6 illustrates that a curved surface, the frusto-shaped inner surface (33) provides a transversely pressure which is distributed along the length of the anchoring device in such a way that the forces are increasing towards the distal end (1) of the anchoring device.

The figures and the description disclose an anchoring device (10) for anchoring tendons for structural reinforcing a structure such as a concrete structure, where the anchoring device (10) has a longitudinal central axis (A) defining an axial direction, and in the axial direction a distal end (1) and a proximal end (2); wherein the anchoring device comprises an outer barrel (20) and an inner wedge (30); wherein said outer barrel (20) has a cylindrical or frusto-conically shaped inner surface (21) defining a cylindrical or frusto-conically shaped inner space (22); and said inner wedge (30) comprises a frusto-shaped outer surface (31) and a coaxial bore (32); and said frusto-conically shaped inner space (22) is configured for allowing said inner wedge (30) to be positioned at least partly in said frusto-conically shaped inner space (22); said frusto-shaped outer surface (31) of said inner wedge (30) converges at the same angle or more toward the longitudinal central axis (A) of the anchoring device than the surface of said frusto-conically shaped inner surface (21) converges towards the longitudinal central axis (A); and said coaxial bore (32) of said inner wedge (30) is configured for receiving a tendon (15), wherein said inner wedge comprises an inner and an outer portion (37,38), the inner portion overlapping the outer portion seen in a radial direction, said inner and outer portion (37,38) extend tangentially to the inner surface (33) of the coaxial bore (32), wherein said inner and said outer portion are separated by a cut (36), said inner wedge is configured for allowing displacement of said outer portion (37) with respect to the said inner portion (38) in the tangential direction, upon insertion of the inner wedge (30) into the outer barrel (20) in the axial direction, upon exertion of radially compressive forces on the wedge such that said inner and outer portion (37,38) increase the overlapping portion and reduce the circumference of the coaxial bore (32).

Figure 7:
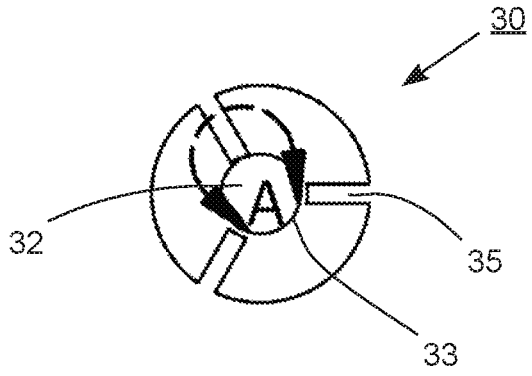
FIG. 7 is an end view of the wedge, and a partial view of the outer portion and the inner portion.
Figure 7:
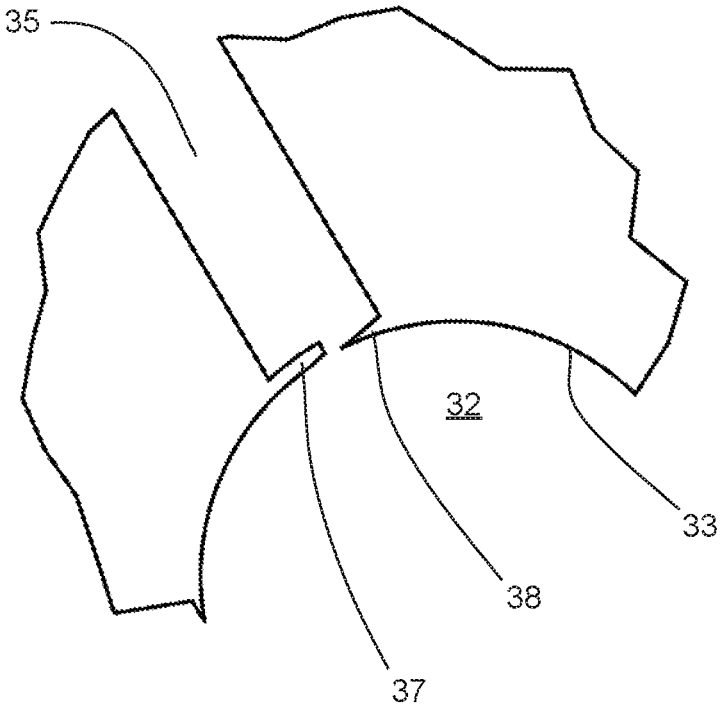

An embodiment of the inner wedge (30) is illustrated in FIG. 7. The inner wedge (30) shown in FIG. 7 has three longitudinal recesses (35), which extends radially from the outer surface (31) of the inner wedge (30) towards the coaxial bore (32) defined by the inner surface (33) of the inner wedge.

FIG. 7 also illustrates a partial view of one of the longitudinal recesses (35), which comprises the inner and outer portion (37,38). Both the inner and the outer portion (37,38) constitutes a tongue abutting portion, the inner portion (38) is illustrated having a tapered surface towards the distal end of the inner portion (38), thus the inner portion is intended to deform and/or slide under the outer portion (37) configured for forming an overlap of the inner and outer portion (37,38) upon exertion of radially compressive forces on the wedge, thereby reducing the circumference of the coaxial bore (32) upon interaction with an outer barrel (20).

The anchoring device may be manufactured by non-corrosive or corrosive materials. In an embodiment, the anchoring device may be manufactured in aluminum, aluminum bronze or aluminum zinc.

The invention claimed is:

1. An anchoring device for anchoring a tendon for structurally reinforcing a structure or a concrete structure, where the anchoring device has a longitudinal central axis defining an axial direction, and in the axial direction a distal end and a proximal end; said anchoring device comprises an outer barrel and an inner wedge; said outer barrel has a cylindrically or frusto-conically shaped inner surface defining a cylindrically or frusto-conically shaped inner space; said inner wedge comprises a frusto-shaped outer surface and a coaxial bore having a circumference; said frusto-conically shaped inner space is configured for allowing said inner wedge to be positioned at least partly in said frusto-conically shaped inner space of the outer barrel in the axial direction; said coaxial bore of said inner wedge is configured for receiving the tendon, wherein said inner wedge comprises an inner and an outer portion, said inner portion overlaps said outer portion as seen in a radial direction, wherein the inner portion and the outer portion are separated by a cut, the cut is configured for increasing said overlap of the inner portion and the outer portion upon exertion of radially compressive forces on the wedge, thereby reducing the circumference of the coaxial bore upon interaction with the outer barrel, wherein the inner wedge comprises one or more longitudinal recesses extending in both the axial direction along an entire length of said inner wedge and in the radial direction from said frusto-shaped outer surface towards the longitudinal central axis, and wherein said cut extends from an inner distal end of said one or more longitudinal recesses to an inner surface of the coaxial bore.

2. The anchoring device according to claim 1, wherein the cut extends axially along the entire length of the inner wedge from the distal end to the proximal end.

3. The anchoring device according to claim 1, wherein the cut extends in a tangential direction from a first radial direction to a second radial direction, enclosing an angle, so as to allow deformation of the inner wedge and reducing a diameter of the coaxial bore upon interaction with the barrel.

4. The anchoring device according to claim 1, wherein the inner surface of said inner wedge has a frusto-shaped surface or a frusto-parabolic shaped surface.

5. The anchoring device according to claim 1, wherein said inner surface of said inner wedge has a frusto-conically shaped surface.

6. The anchoring device according to claim 1, wherein said inner and outer portions form a curved overlap.

7. The anchoring device according to claim 1, wherein said cut constitutes a spiral-shaped curved cut.

8. The anchoring device according to claim 1, wherein the one or more longitudinal recesses extend helically along the entire length of the inner wedge.

9. The anchoring device according to claim 1, wherein at least part of the anchoring device is manufactured by laser cutting.

10. The anchoring device according to claim 1, wherein at least part of the anchoring device is manufactured by 3D printing.

11. The anchoring device according to claim 1, wherein at least part of the anchoring device is manufactured in aluminum.

12. The anchoring device according to claim 1, wherein at least part of the anchoring device is formed in a non-corrosive material.

13. The anchoring device according to claim 1, wherein said inner portion constitutes a tongue, and said outer portion constitutes a tongue abutting surface.

14. The anchoring device according to claim 13, wherein the cut extends axially along the entire length of the inner wedge from the distal end to the proximal end.

15. The anchoring device according to claim 13, wherein the cut extends in a tangential direction from a first radial direction to a second radial direction, enclosing an angle, so as to allow deformation of the inner wedge and reducing a diameter of the coaxial bore upon interaction with the barrel.

16. The anchoring device according to claim 13, wherein the inner surface of said inner wedge has a frusto-shaped surface or a frusto-parabolic shaped surface.

17. The anchoring device according to claim 13, wherein the cut extends axially along the entire length of the inner wedge from the distal end to the proximal end, and wherein the cut extends in a tangential direction from a first radial direction to a second radial direction, enclosing an angle, so as to allow deformation of the inner wedge and reducing a diameter of the coaxial bore upon interaction with the barrel.

18. The anchoring device according to claim 13, wherein said inner and outer portions form a curved overlap.

* * * * *